United States Patent [19]

Tumber

[11] Patent Number: 4,462,371

[45] Date of Patent: Jul. 31, 1984

[54] FUEL PUMPING APPARATUS

[75] Inventor: Brian W. Tumber, Greenford, England

[73] Assignee: Lucas Industries Limited, Birmingham, England

[21] Appl. No.: 451,854

[22] Filed: Dec. 21, 1982

Related U.S. Application Data

[63] Continuation of Ser. No. 162,022, Jun. 23, 1980, abandoned.

[30] Foreign Application Priority Data

Sep. 8, 1979 [GB] United Kingdom ..... 7931256

[51] Int. Cl.[3] ..... F02M 39/00; F04B 23/10

[52] U.S. Cl. ..... 123/450; 417/462; 417/206

[58] Field of Search ..... 123/450, 500, 502; 417/206, 462, 251, 252, 253

[56] References Cited

U.S. PATENT DOCUMENTS

| | | | |
|---|---|---|---|
| Re. 23,889 | 10/1954 | Seaver | 123/450 |
| 2,163,458 | 6/1939 | Clark | 123/450 |
| 3,485,225 | 12/1969 | Bailey | 123/450 |
| 4,073,276 | 2/1978 | Nicolls | 123/450 |
| 4,173,959 | 11/1979 | Sosnowski | 417/462 |
| 4,348,995 | 9/1982 | Jefferson | 417/462 |
| 4,358,256 | 11/1982 | Jefferson | 223/450 |
| 4,362,140 | 12/1982 | Jefferson | 417/462 |
| 4,401,084 | 8/1983 | Jarrett | 123/450 |
| 4,422,425 | 12/1983 | Jefferson | 417/253 |

FOREIGN PATENT DOCUMENTS

| | | | |
|---|---|---|---|
| 1209065 | 2/1960 | France | 123/450 |

*Primary Examiner*—Charles J. Myhre
*Assistant Examiner*—Carl Stuart Miller

[57] ABSTRACT

A fuel injection pumping apparatus for supplying fuel to an engine is of the rotary distributor type and has an annular cam ring having cam lobes for imparting inward movement to a pumping plunger. The trailing flanks of the cam lobes define metering portions which are less steep than those of known pumps so as to extend the time during which the outward movement of the plunger is controlled by the cam lobes. In addition the apparatus includes a sleeve slidable in the distributor member of the apparatus and this incorporates a shaped recess which communicates with a source of fuel. The bore containing the plunger communicates with an inlet port which can be uncovered to the recess while the plunger is under the contact of the metering portion of the cam lobe. The sides of the recess are not parallel so that the amount of fuel which flows to the bore depends on the setting of the sleeve.

3 Claims, 8 Drawing Figures

FUEL PUMPING APPARATUS

This is a continuation of application Ser. No. 162,022, filed June 3, 1980, now abandoned.

This invention relates to fuel injection pumping apparatus for supplying fuel to an internal combustion engine and of the kind comprising a rotary distributor member, a plunger movable within a bore, a cam including a cam lobe for imparting inward movement to the plunger, fuel displaced from said bore during inward movement flowing by wy of passage means in the distributor member, to an outlet, a source of fuel under pressure and means for controlling the amount of fuel supplied to the bore from said source thereby to control the quantity of fuel supplied by the apparatus at each delivery stroke of the plunger.

In one known form of such apparatus the flow of fuel to the bore is controlled by an adjustable throttle. The flow of fuel to the bore takes place whilst a supply port is open to a passage communicating with said bore. The flow of fuel which takes place for a given setting of the throttle does depend upon a number of factors for example, the pressure of fuel supplied by the source, the viscosity of the fuel and therefore the temperature thereof and also the time the port is open to the passage. In another construction a quantity of fuel is metered using a shuttle slidable within a cylinder, the extent of movement of the shuttle within the cylinder being a measure of the amount of fuel supplied to the bore. With this arrangement complex changeover valves must be provided to admit fuel to the ends of the cylinder in turn and to permit fuel flow from the opposite ends of the cylinder in turn. In addition, unless special precautions are taken, there is the possibility of cavitation occurring during the supply of fuel to the bore and when the shuttle contacts the end of the cylinder.

A further manner of measuring the fuel before it is admitted to the pumping apparatus is shown in Nicolls U.S. Pat. No. 4,073,276 in which a piston movable in a cylinder, is actuated by an actuating device the movement of which can be accurately controlled to give the piston a precise movement. The actuating device is a piezo-electric crystal unit which requires elaborate high voltage circuits to make it function. Agent from the risk to life, the design of high voltage circuits which are sufficiently reliable to be able to operate in close proximity to an engine and are also sufficiently cheap has proven to be impossible. Ignoring such practical difficulties it must be emphasized that Nicolls measures the fuel externally of the injection pump.

The object of the present invention is to provide an apparatus of the kind specified in a simple and convenient form.

According to the invention, in an apparatus of the kind specified the trailing face of the cam lobe defines a metering portion and said means controls the flow of fuel from said source to the bore while the plunger is moving under the control of said metering portion of the cam lobe.

An example of an apparatus in accordance with the invention will now be described with reference to the accompanying drawings in which.

Figure 1:
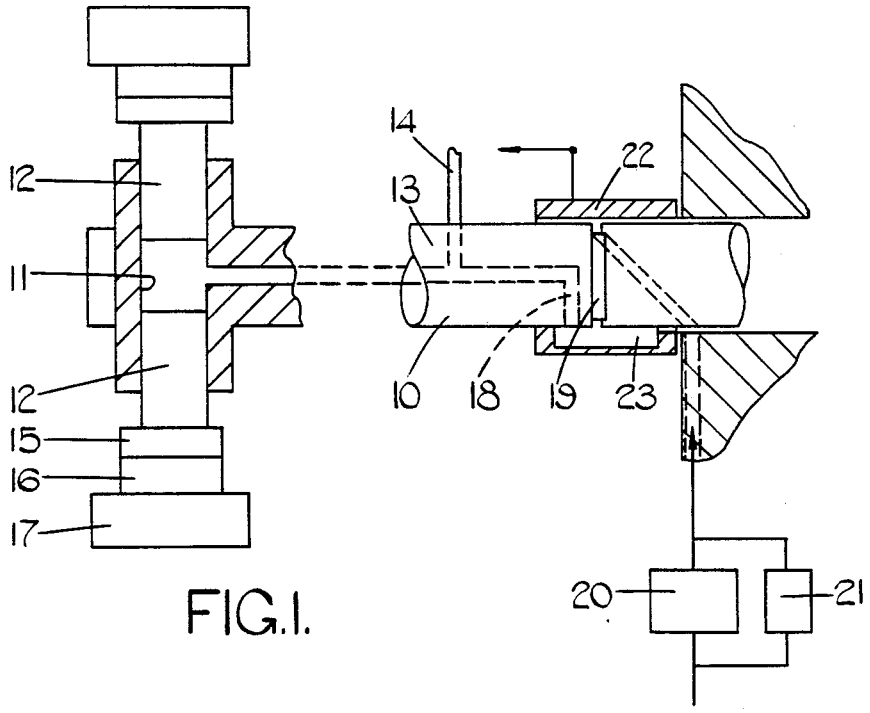
FIG. 1 is a diagrammatic representation of the apparatus.

With reference to FIG. 1, the apparatus comprises a rotary distributor member 10 which is housed within a body part (not shown). The distributor member is adapted in use to be driven in timed relationship with the associated engine and forward within the distributor member is a transversely extending bore 11 which accommodates a pair of pumping plungers 12. The bore 11 communicates with a delivery passage 13 in the distributor member and this cam communicate in turn as the distributor member rotates, with outlets 14 only one of which is shown, formed in the body part and communicating in use, with the injection nozzles of the associated engine.

Figure 3:
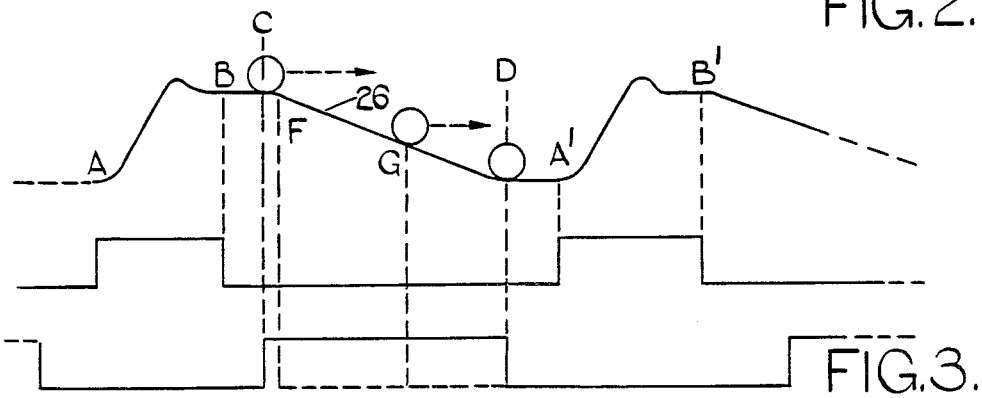
FIG. 3 is a diagram similar to FIG. 2 of the apparatus shown in FIG. 1, FIGS. 4, 5 and 6 show a part of the apparatus at different settings.

At their outer ends the plungers are engaged by shoes 15 which carry rollers 16 for engagement with pairs of cam lobes with the internal peripheral surface of an annular cam ring 17. A developed view of part of the cam ring applicable to the example of FIG. 1, is shown in FIG. 3.

Also formed in the distributor member is a supply port 18 and a circumferential groove 19 which is in constant communication with the outlet of a fuel supply pump 20. The pump 20 draws fuel from a tank (not shown), and the outlet pressure of the pump is controlled by the valve 21. Surrounding the distributor member 10 is a sleeve 22 and formed in the internal peripheral surface of the sleeve is a plurality of shaped recesses 23 by which means the supply port can be brought into register with the groove 19.

In operation, a quantity of fuel is supplied to the bore 11, the quantity being determined in a manner to be described, and the plungers move outwardly. As the distributor member further rotates the port 18 moves out of register with the recess 23 and the passage 13 moves into register with one of the ports 14. Once this latter communication is established the plungers 12 are moved inwardly and fuel is supplied to the associated engine.

Figure 2:
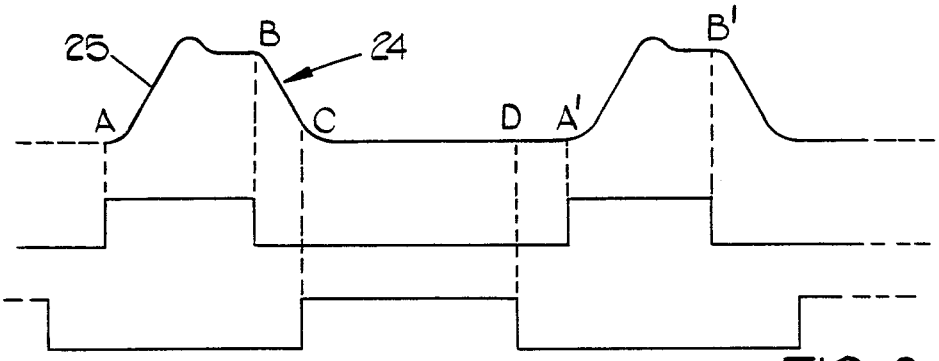
FIG. 2 is a diagram of a cam lobe and the associated ports of a known form of apparatus.

Turning now to FIG. 2, the cam profile shown in the upper portion of the drawing is the profile of a cam for an apparatus of the type described but which has a throttle for determining the amount of fuel which is supplied to the bore. The lobes are diametrically disposed so that the plungers are moved inwardly at the same time. Each lobe includes a leading flank 25 and which co-operates with a roller 16 to effect inward movement of the plunger. The delivery passage 13 is open to an outlet 14 during the period A-B indicated in FIG. 2. It will be noted that the communication remains established after the roller has moved over the crest of the cam lobe during which the plunger is allowed limited outward movement. The purpose of this is to lower the fuel pressure in the supply line connecting the outlet with the aforesaid injection nozzle. At point B the trailing flank of the lobe drops steeply to point C which is more or less on the base circle of the cam. At this point, fuel is supplied to the bore through a port which is opened at point C and the flow of fuel is determined by a throttle. This port is closed at D and the delivery passage moves into register with the next outlet 14 at A' ready for the next inward movement of the plunger.

Turning now to FIG. 3 it will be seen that the profile of the cam lobe is considerably altered and that the steep portion of the trailing flank extends almost to the beginning of the leading flank of the next lobe. In FIG. 3 this portion of the cam lobe is referenced 26 and is referred to herein as the metering portion of the cam lobe. Moreover, it will be seen from FIG. 3 that the delivery passage 13 moves out of register with an outlet 14 slightly earlier than in the known construction but that the same relief of pressure takes place. The port 18 and the circumferential groove 19 are brought into register at position C which is at the beginning of the metering portion 26. The period in terms of degrees of rotation of the distribution member, during which the passage 18 is in communication with the groove 19 determines the amount of fuel which flows to the bore 11 and as will be seen from FIG. 3, as the period is extended, more fuel will be supplied to the bore.

It will thus be seen that the plunger roller 16 moves a specific distance along the trailing flank so that the amount of fuel supplied to the bore 11 is directly related to the specific distance on the trailing flank. The plunger is thus under the control of the trailing flank at substantially any angular orientation of the distributor member.

Moreover, the fuel quantity is measured within the injection pumping apparatus by extending the trailing flank of the cam lobe so that it is gently sloped as shown in FIG. 3. The filling period is appreciably longer than the injection period and furthermore, the filling pressure is substantially lower than the injection pressure. There is therefore much more time available for filling to take place and furthermore it is possible to have a substantially linear trailing flank.

It should be noted here that while in the Nicolls U.S. Pat. No. 4,073,276 referred to above, there is shown that the plungers are engaged against the trailing flanks of the cam lobes and therefore under the control of same, this depends upon the pressure at which fuel is delivered from the piezo-electrically operated piston. If the rate of fuel supply is low then the plungers may not move outwardly sufficiently quickly to be able to say they are controlled by the trailing flanks of the cam lobes. On the other hand, if the pressure of fuel delivered by the piezo-electrically operated piston is high, then the plungers or rollers may in fact contact the trailing flanks of the cam lobes. There is however no measurement achieved even if they do contact the cam lobes since all the measuring is done external of the injection pump.

Figure 4:
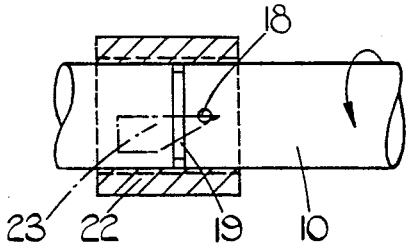
Figure 5:
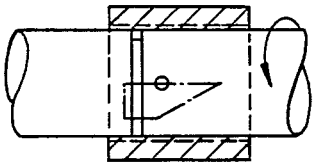
Figure 6:
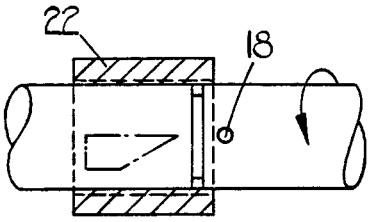

Turning now to FIGS. 4, 5 and 6, it will be seen that the opposed walls of the recess 23 in the wall of the sleeve 22 are not parallel and one end portion of the recess is of generally triangular shape. In FIG. 4 there is indicated the direction of rotation of the distributor member 10 and it will be observed that whatever the axial setting of the sleeve on the distributor member, the passage 18 will open to the recess 23 at the same angular position. The axial setting of the sleeve does however affect the instant at which the communication is broken and in the position of the sleeve shown in FIG. 4, the amount of fuel supplied to the bore will be small. In FIG. 5 it will be observed that the sleeve has been moved axially to a position in which the passage 18 and groove 19 are connected for the maximum period of time. This position therefore corresponds to the maximum fuel position.

In FIG. 6, the sleeve 22 is shown as being moved axially to the extreme left in which the passage 18 is exposed beyond the sleeve. The passage 18 will therefore be in communication with the interior of the housing of the apparatus. However, even if the plungers move outwardly as permitted by the cam lobes, during their inward movement any fuel contained in the bore 11 will flow back into the housing of the apparatus and will not be delivered to the associated engine.

In a practical arrangement the sleeve 22 will be connected to a governor mechanism and the sleeve will assume the position shown in FIG. 6 when the engine speed either exceeds the permitted value or the operator moves his control to reduce the speed of the engine.

It will be appreciated that with a single passage 18, the sleeve 22 will have four recesses 23 formed on its internal peripheral surface for an apparatus for supplying fuel to a four cylinder engine. There will be two pairs of cam lobes and fuel delivery will take place four times during each revolution of the distributor member. It will of course be provided with four outlets 14. As an alternative to providing four recesses on the internal periphery of the sleeve, a single recess as shown can be provided with four passages 18.

Figure 7:
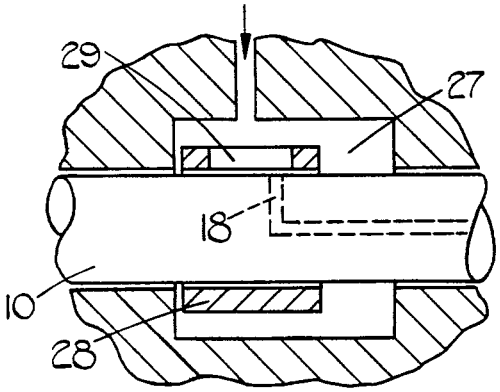
FIG. 7 shows a modification to the apparatus shown in FIG. 1.

A modification is seen in FIG. 7, and in this case the distributor member 10 extends through a chamber 27 defined in the housing of the apparatus, the chamber 27 being in communication with the outlet of the pump 20. Moreover, the sleeve 28 is provided with an aperture 29 corresponding to the shape of the recess 23.

Figure 8:
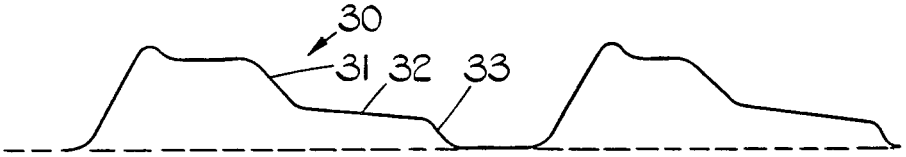
FIG. 8 shows a modified cam lobe diagram.

In FIG. 8, the metering portion 30 of the cam lobe is shaped to provide a first relatively steep portion 31 followed by a second less steep portion 32 and finally a relatively steep portion 33. The intermediate portion 32 provides for fine control of the amount of fuel supplied by the apparatus as the delivery of the apparatus approaches its maximum value. The portion 33 is for the purpose of providing excess fuel for starting purposes and it will be seen that it dips down towards the base circle of the cam.

As mentioned above, the sleeve is connected to the output member of a governor which may be a mechanical governor housed in the housing of the apparatus. Alternatively, the sleeve may be operated electrically by means of an actuator such for example as a torque motor which is driven by an electronic governor arrangement. A transducer may be provided to provide an indication of the actual position of the sleeve.

In order to adjust the timing of delivery of fuel to the associated engine the cam ring 17 is angularly adjustable within the body part. Such angular adjustment is equivalent to moving the sleeve angularly in other words the amount of fuel supplied would also alter. In order to avoid this the sleeve is moved angularly by the same amount and in the same direction as the cam ring. This having the effect of varying the timing of delivery of fuel without altering the quantity.

Alternatively the cam ring may be moved angularly and the sleeve moved axially by an amount to maintain the quantity of fuel delivered constant. This method of connection is particularly suited to an apparatus in which the axial setting of the sleeve and the angular setting of the cam ring are determined by an electronic governor including a microprocessor which is programmed to take account of the matering characteristic.

I claim:

1. A fuel injection pumping apparatus for supplying fuel to an internal combustion engine and of the kind comprising a rotary distributor member, a plunger movable within a bore, a roller controlling movement of said plunger, a cam which includes a base circle and a plurality of cam lobes, each cam lobe having a leading flank for imparting inward movement to the plunger and a trailing flank, fuel displaced from said bore during inward plunger movement flowing by way of passage means in the distributor member to an outlet, a source of fuel under pressure and fuel inlet control means for controlling the amount of fuel supplied to the bore from said source thereby to control the quantity of fuel supplied by the apparatus at each delivery stroke of the plunger, characterized in that the trailing flank of each of said cam lobes extends to a location almost adjacent to the leading flank of the next adjacent cam lobe, said trailing flanks being gently sloped with respect to said cam ring base circle to thereby extend the time during which outward movement of said plunger is controlled by said cam lobe so that said plunger is under control of a trailing flank at substantially any angular orientation of said rotor distributor, said fuel inlet control means being formed to establish fluid communication between said fuel source and said bore for a predetermined amount of time during which said roller is forced to constantly engage a trailing flank and moves a specific distance along said flank, the amount of fuel supplied to said plunger being directly related to said specific distance so that said trailing flank defines a metering portion and said inlet control means acts as an on/off valve to control the flow of fuel from said source to the bore while the plunger is moving outwardly against and constantly under the control of said metering portion of each cam lobe.

2. An apparatus according to claim 1 characterised in that said fuel inlet control means comprises a sleeve surrounding the distributor member, a recess in the internal surface of said sleeve passage means connecting said recess with said source of fuel under pressure, an inlet port opening onto the periphery of the distributor member, said port communicating with the bore containing the plunger, said recess having opposed non-parallel walls whereby the axial setting of the sleeve on the distributor member will vary the duration of opening of said inlet port.

3. An apparatus according to claim 1 or claim 2 characterised in that said metering portion of the trailing flank of the cam lobe has a plurality of portions of different slopes.

* * * * *